US006666954B2

(12) United States Patent
Kotitschke et al.

(10) Patent No.: US 6,666,954 B2
(45) Date of Patent: Dec. 23, 2003

(54) PRESSING ARRANGEMENT

(75) Inventors: Gerhard Kotitschke, Steinheim (DE); Wolfgang Mayer, Heidenheim (DE); Roland Mayer, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 293 days.

(21) Appl. No.: 09/800,475

(22) Filed: Mar. 8, 2001

(65) Prior Publication Data

US 2001/0020524 A1 Sep. 13, 2001

(30) Foreign Application Priority Data

Mar. 13, 2000 (DE) ..... 100 12 148
Nov. 13, 2000 (DE) ..... 200 19 256 U

(51) Int. Cl.[7] ..... D21F 3/04

(52) U.S. Cl. ..... 162/205; 162/358.1; 162/358.3; 162/360.2

(58) Field of Search ..... 162/205, 358.1, 162/358.3, 360.2

(56) References Cited

U.S. PATENT DOCUMENTS 4,586,984 A 5/1986 Laapotti ..... 162/360.3
4,662,992 A * 5/1987 Mirsberger ..... 162/358.3
4,909,903 A * 3/1990 Mullner ..... 162/358.3
5,647,960 A * 7/1997 Kotitschke et al. ..... 162/360.3
5,951,821 A * 9/1999 Laapotti ..... 162/360.2
6,090,244 A * 7/2000 Kotitschke et al. ..... 162/360.2
6,332,955 B1 12/2001 Meschenmoser ..... 162/360.3
2001/0009181 A1 * 7/2001 Steiner et al. ..... 162/360.2

FOREIGN PATENT DOCUMENTS

DE 29800330 U 6/1998
DE 19801417 7/1999
DE 19802054 7/1999
DE 19848284 10/1999
DE 29823556 U 10/1999

OTHER PUBLICATIONS

Smook, "Handbook of Pulp & Paper Terminology" p. 171, Angus Wilde Publications, 1990.*

* cited by examiner

*Primary Examiner*—Peter Chin
(74) *Attorney, Agent, or Firm*—Greenblum & Bernstein, P.L.C.

(57) ABSTRACT

Pressing arrangement having two press rolls forming at least one press nip for dewatering a web, and two dewatering belts arranged to be guided through the at least one press nip with the web. The dewatering belts positioned on opposite sides of the web to absorb water. A common guidance path, formed by the dewatering belts guiding the web, is located after the at least one press nip. A separating roll and a lower one of the dewatering belts is arranged to wrap the separating roll along with the web at an end of the common guidance path. An upper one of the dewatering belts is arranged to be guided away from the web in a separation path in a region of the separating roll. Lower dewatering belt and web wrap the separating roll subsequent to the separation path at a wrapping angle of at least about 30°.

34 Claims, 1 Drawing Sheet

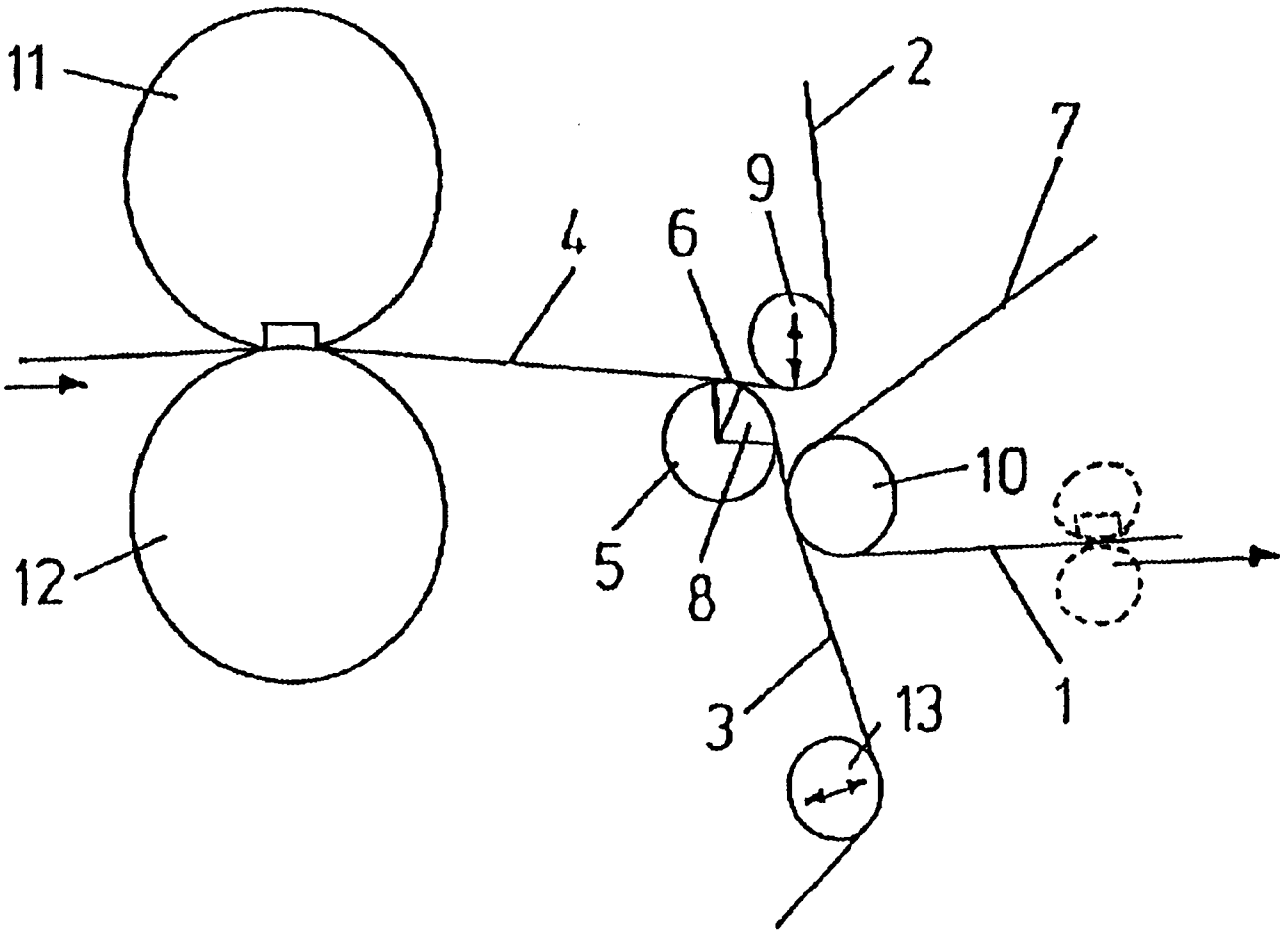
1
2
3
4
5
6
7
8
9
10
11
12
13

PRESSING ARRANGEMENT

CROSS-REFERENCE TO RELATED APPLICATIONS

The present application claims priority under 35 U.S.C. § 119 of German Patent Application No. 100 12 148.9, filed on Mar. 13, 2000 and German Patent Application No. 200 19 256.6, filed on Nov. 13, 2000, the disclosures of which are expressly incorporated by reference herein in their entireties.

BACKGROUND OF THE INVENTION

1. Field of the Invention

The invention relates to a pressing arrangement with at least one pressing nip formed by two pressing rolls for dewatering a paper, cardboard, tissue, or other fibrous material web, through which one dewatering belt is guided next to the fibrous material web on each side for the purpose of absorbing the pressed-out water, in which the fibrous material web is guided by both dewatering belts in a common guidance path after the pressing nip, the lower dewatering belt running below the fibrous material web wraps a preferably suctioned separating roll along with the fibrous material web at the end of the guidance path, the upper dewatering belt arranged above the fibrous material web is guided away from the fibrous material web in a separation path in the region of the separating roll, and the fibrous material web is subsequently accepted by a removal belt.

2. Discussion of Background Information

Such arrangements have been known for a long time in which the fibrous material web is held onto the lower dewatering belt after the removal of the upper dewatering belt with the aid of suction or blowing devices. The effect, especially of the suction devices, on the fibrous material web decreases with increased web speed, higher water contents in the dewatering belt, and increasing wear on the dewatering belt. As a result, the adhesion of the fibrous material web to the lower dewatering belt decreases, which can lead to fluttering of the web edges and thus to increased stretching of the web edges.

Furthermore, after the separation path, air flows into the wedge-shaped opening between the fibrous material web and the upper dewatering belt. This stream of air can also lead to a lifting of the web edges and to the formation of flutters.

SUMMARY OF THE INVENTION

The present invention provides for the guidance of the fibrous material web, in particular after the separation path, i.e., the removal of the upper dewatering belt.

According to the invention, the wrapping of the separating roll by the lower dewatering belt and the fibrous material web subsequent to the separation path occurs at a wrapping angle of at least about 30°. This relatively large wrapping angle leads to a rapidly widening wedge-shaped opening between the fibrous material web and the upper dewatering belt, which allows air to flow in without the danger of web fluttering. Advantageously, the wrapping angle is at least about 45°, preferably even at least about 60°.

By the vacuum acting on the fibrous material web, the suctioned separating roll increases the adhesion of the fibrous material web onto the lower, air-permeable dewatering belt over the entire region of the wrapping. So that the adhesion of the fibrous material web to the lower dewatering belt can increase sufficiently and its adhesion to the upper dewatering belt can decrease sufficiently, the time the fibrous material web remains in the separation path should be greater than about 1 ms, preferably greater than about 15 ms. This allows the subsequent removal of the upper dewatering belt without the danger of snagging with respect to the fibrous material web.

In order to greatly limit the length of the wedge-shaped opening between the upper and lower dewatering belts, the upper dewatering belt should be guided after the separation path to a guidance roll, which deflects this dewatering belt; it is advantageous for the unsupported progression of the dewatering belt to be as short as possible and between about 20 and about 200 mm, preferably between about 20 and about 80 mm, long. This results in a decrease in the air flow into the wedge-shaped opening that undermines the guidance of the fibrous material web on the lower dewatering belt. Furthermore, the position of the guidance roll of the upper dewatering belt should be changeable and a wrapping angle of the upper dewatering belt with respect to the separating roll of the lower dewatering belt should be adjustable thereby between about 0° and about 5°.

Furthermore, the angle between the common guidance path (sandwich guidance) subsequent to the pressing nip and the pressing plane formed by the pressing rolls should preferably be variable in the range of ±about 5°. If the sandwich guidance runs at an incline, this is connected with a more intensive downwards dewatering and thus a greater compacting of the lower side of the fibrous material web. On the other hand, a declining sandwich guidance leads to a more intensive upwards dewatering and thus to a greater compacting of the upper side. This offers an effective way for influencing the two-sidedness of the fibrous material web, in particular with regard to surface strength, oil absorption, and printability.

The goal of the invention is to avoid long, level sandwich guidances of the dewatering belt and the fibrous material web. The lower belt can also be embodied as a plastic belt with a dense surface that is closed to the greatest extent possible. In this case, a normal guidance roll is used instead of the suctioned separating roll. Here, a relatively smooth surface guarantees the adhesion of the fibrous material web to the lower belt.

It is advantageous with respect to the further secure travel of the fibrous material web for the fibrous material web to travel from the separating roll to a suctioned removal roll arranged at a distance from it and wrapped by the air-permeable removal belt, where the fibrous material web is accepted by the removal belt. Here, the clear distance between the separating roll and the removal roll should be as small as possible, i.e., smaller than about 500 mm, and preferably between about 20 and about 200 mm, in particular between about 20 and about 80 mm. Because of the short distance between the separating and removal rolls, web stabilizers and additional blowing or suction devices can be eliminated in this region. Furthermore, this leads to a shortening of the wedge-shaped opening and thus to a decrease in the working surface of the fibrous material web.

It is also advantageous for the lower dewatering belt to wrap an adjustable guiding roll after the transfer of the fibrous material web and for a gap, a contact, or a wrapping of the lower dewatering belt to be adjustable in relation to the removal roll by this guide roll. This allows the formation of a relatively large wrapping angle, for example, for the secure transfer of the fibrous material web.

In order to be able to compensate for stretching of the moist fibrous material web for the purpose of preventing the formation of folds, the accepting belt should have a higher speed than the lower dewatering belt.

The removal belt can be formed as a pressing felt of a subsequent pressing nip, as a transfer belt for subsequent transport, or as a drying wire of a subsequent drying group for drying the fibrous material web. Here, the distance between the guiding roll of the upper dewatering belt and the removal belt should be adjustable so as to control thereby the air introduced into the wedge-shaped opening.

In order to achieve an intensive but gentle dewatering of the fibrous material web, it is advantageous for the pressing nip of the pressing arrangement to be embodied in an elongated fashion. Because of the considerable amounts of water that result in this case, at least the lower dewatering belt, preferably both dewatering belts, should be embodied as a pressing felt.

Particular advantages result with regard to an improved guidance of the fibrous material web in pressing arrangements with two pressing nips, both of which should preferably be embodied in an elongated fashion. However, at least the second pressing nip should be embodied in an elongated fashion. Here, the arrangement according to the invention can be implemented between the pressing nips and/or between the last pressing nip and a subsequent drying group.

The pressing arrangement is particularly suited for web speeds of the fibrous material web greater than 1500 m/min.

The present invention is directed to a pressing arrangement that includes two press rolls arranged to form at least one press nip for dewatering a fibrous material web, and a first and a second dewatering belt arranged to be guided through the at least one press nip with the fibrous material web. The first and second dewatering belts are positioned on opposite sides of the fibrous material web to absorb pressed-out water. A common guidance path, formed by the first and second dewatering belts guiding the fibrous material web, is located after the at least one press nip, relative to a web travel direction. A separating roll is provided, and a lower one of the first and second dewatering belts is positioned below the fibrous material web and arranged to wrap the separating roll along with the fibrous material web at an end of the common guidance path. An upper one of the first and second dewatering belts is positioned above the fibrous material web and arranged to be guided away from the fibrous material web in a separation path in a region of the separating roll. The lower dewatering belt and the fibrous material web are arranged to wrap the separating roll subsequent to the separation path, relative to the web travel direction, at a wrapping angle of at least about 30°.

In accordance with a feature of the instant invention, a removal belt can be arranged to accept the fibrous material web from the lower dewatering belt. The removal belt may include a pressing felt of a subsequent pressing nip. Further, the removal belt can include a transfer belt. Still further, the removal belt may include a drying wire of a subsequent drying group for drying the fibrous material web.

The separating roll can include a suction roll. The fibrous material web may be a paper, cardboard, or tissue web.

According to another feature of the instant invention, the wrapping angle can be at least about 45°. Further, the wrapping angle may be about 60°.

A time that the fibrous material web remains in the separation path may be greater than about 1 ms, and the time that the fibrous material web remains in the separation path can be greater than about 15 ms.

A guide roll can be arranged to deflect the upper dewatering belt after the separation path. An unsupported progression of the upper dewatering belt between the separating roll and the guide roll can be formed, which is between about 20–200 mm long. Further, the unsupported progression can be between about 20–80 mm long. The guide roll can be positionably adjustable so as to adjustably set a wrapping angle of the upper dewatering belt on the separating roll of between about 0°–5°. Still further, a removal belt may be arranged to accept the fibrous material web from the lower dewatering belt. A distance between the guide roll and the removal belt can be adjustable.

In accordance with still another feature of the present invention, a suctioned removal roll and an air-permeable removal belt can be wrapped over the suctioned removal roll. The removal roll may be arranged at a distance from the separation roll, such that the fibrous material web and the lower dewatering belt travels from the separating roll to the suctioned removal roll, and the removal belt may be arranged to accept the fibrous material web from the lower dewatering belt. A clear distance between the separating roll and the removal roll may be between about 20–200 mm. Further, the clear distance between the separating roll and the removal roll may be between about 20–80 mm. An adjustable guide roll can be arranged after an acceptance point for the transfer of the fibrous material web to the removal belt to deflect the lower dewatering belt. The guide roll may be positionably adjustable to position the lower dewatering belt one of at a distance from, in contact with, or to wrap the removal roll. The removal belt can be driven at a greater speed than the lower dewatering belt.

At least the lower dewatering belts can include a pressing felt. The upper and lower dewatering belt can include pressing felts.

The at least one press nip can include an press nip elongated in the web travel direction.

A second press nip is provided. At least a last pressing nip arranged in the web travel direction comprises a press nip elongated in the web travel direction. Both press nips can be elongated in the web travel direction.

The present invention is directed to a process of guiding a fibrous material web in an apparatus that includes a press nip formed by two press rolls, and a first dewatering belt and a second dewatering belt arranged on opposite sides of the fibrous material web to guide the fibrous material web through the press nip. The process can include guiding the fibrous material web between the first and second dewatering belts over a common guidance path after the press nip to a separating roll, separating an upper one of the first and second dewatering belts from the fibrous material web and a lower one of the first and second dewatering belts in a separation path in a region of the separating roll, and wrapping the separating roll with the lower dewatering belt and the fibrous material web after the separation path, relative to the web travel direction, at a wrapping angle of at least about 30°.

In accordance with a feature of the instant invention, the process can further include removing the fibrous material web from the lower dewatering belt with a removal belt.

According to another feature of the present invention, the process can include suctioning the lower dewatering belt and the fibrous material web as they wrap the separating roll.

Further, the wrapping angle can be at least about 45°, and the wrapping angle may be about 60°.

The process can further include maintaining the fibrous material web in the separation path for a time greater than about 1 ms. Further, the time that the fibrous material web remains in the separation path can be greater than about 15 ms.

Moreover, the process may include deflecting, via a guide roll, the upper dewatering belt after the separation path, to form an unsupported progression of the upper dewatering belt between the separating roll and the guide roll which is between about 20–200 mm long. The unsupported progression can be between about 20–80 mm long. Further, the process may include adjustably setting, via the guide roll, a wrapping angle of the upper dewatering belt on the separating roll of between about 0°–5°.

According to still another feature of the invention, the process may include removing the fibrous material web from the lower dewatering belt via an air-permeable removal belt guided over a suctioned removal roll. The removal roll may be arranged at a distance from the separation roll, such that the fibrous material web and the lower dewatering belt travels from the separating roll to the suctioned removal roll. A clear distance between the separating roll and the removal roll can be between about 20–200 mm, and the clear distance between the separating roll and the removal roll may be between about 20–80 mm.

The process may also include deflecting, via a guide roll, the lower dewatering belt after an acceptance point for the removal of the fibrous material web from the lower dewatering belt so that the lower dewatering belt is adjustably positioned one of at a distance from, in contact with, or to wrap the removal roll.

In accordance with yet another feature of the instant invention, the process may include driving the removal belt at a greater speed than the lower dewatering belt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE schematically illustrates a cross section of a pressing arrangement according to the invention for dewatering a fibrous material web.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Besides the fibrous material web 1, at least one dewatering belt 2, 3, on each side in the form of an air-permeable pressing felt for absorbing and removing the pressed-out water is guided through the pressing nip formed by two pressing rolls 11, 12 pressed against one another. In order to allow an intensive yet gentle dewatering, the pressing nip is embodied in an elongated fashion. For this purpose, the upper pressing roll 11 has a flexible roll jacket that runs over a pressing shoe with a concave pressing surface.

After the pressing nip, the fibrous material web 1 is guided in a common guidance path 4 by both dewatering belts 2, 3. In order to limit reverse moistening, this guidance path 4 should be as short as possible.

At the end of the guidance path 4, the lower dewatering belt 3 running below the fibrous material web 1 wraps a suctioned separating roll 5 along with the fibrous material web 1 at a wrapping angle 8 of approximately 60°. The increased adhesion of the fibrous material web 1 due to the vacuum on the separating roll 5 allows the separation and subsequent removal of the upper dewatering belt 2 from the fibrous material web 1 in a separation path 6. This separation path 6 forms the end of the common guidance path 4, with the time the fibrous material web 1 remains in the separation path 6 lying between about 1 and about 5 ms.

After the separation path 6, the upper dewatering belt 2 is guided to a guiding roll 9 whose position can be altered in the vertical direction such that a light wrapping of the separating roll 5 by the upper dewatering supply 2 of about 0°–5° may be set. The deflection and continued guidance of the upper dewatering belt 2 occurs at the guidance roll 9. In order to structure the wedge-shaped opening between the fibrous material web 1 and the upper dewatering belt 2 to be as short as possible, the free, unsupported progression of the dewatering belt 2 between the separating roll 5 and the guidance roll 9 is less than about 80 mm. The shortening of the wedge-shaped opening limits the streaming of air into the wedge-shaped opening that impairs the guidance of the fibrous material web 1.

From the separating roll 5, the fibrous material web 1, along with the lower dewatering belt 3, travels to a suctioned removal roll 10, which is wrapped by an air-permeable removal belt 7. Here, the vacuum of the removal roll 10 supports the transfer of the fibrous material web 1 from the lower dewatering belt 3 to the removal belt 7. In order to limit the endangered region in which the fibrous material web 1, along with the lower dewatering belt 3, travels between the separating roll 5 and the removal roll 10 without web stabilizers, suction devices, or blowing devices, the clear, i.e., shortest, distance between the separating roll 5 and the removal roll 10 is less than about 80 mm.

In order to compensate for stretching in the moist fibrous material web 1, the removal belt 7 travels somewhat faster than the lower dewatering belt 3. This pull is so small that no negative effects on web guidance are to be expected. It depends on the moist stretching of the fibrous material web 1, the machine speed, and the elongation in the drying section. It should be approximately about 0.5–1.0% between two presses and approximately about 2.5–4.0% between the last press and the drying section. Furthermore, after the transfer of the fibrous material web 1, the lower dewatering belt 3 is guided over an adjustable guidance roll 13. By its adjustability, a wrapping of the removal belt 10 can be achieved that can be advantageous in the transfer of the fibrous material web 1. After the successful transfer, a contact or a gap can again be placed between the lower dewatering belt 3 and the removal roll 10 with the removal belt 7.

In order to be able to counteract a compression of the lower dewatering belt 3 after the separating roll 5 and thus a lifting of the web edges of the fibrous material web 1, besides the pressing roll 12 and the separating roll 5, the guidance roll 13 of the lower dewatering belt 3 subsequent to the transfer of the fibrous material web 1 should also be able to be driven.

The guidance roll 9, which is adjustable in its height, of the upper dewatering belt 2 makes it possible to influence the gap between this guidance roll 9 and the removal roll 7 and thus the amount of air introduced into the wedge-shaped gap.

The removal belt 7 can be embodied as a pressing felt of a subsequent pressing nip or as a drying wire of a subsequent drying group.

The suctioned rolls have a perforated roll jacket whose inner chamber is connected to a vacuum source. Here, the suctioned area of the guide rolls can be changeable in its extent crosswise to the fibrous material web 1 and/or be separated into separately controllable vacuum zones. More advantageously, separate high-vacuum zones should be assigned to the web edges of the fibrous material web 1 because of the increased danger of lifting.

Naturally, the distances between the guidance rolls must comply with safety regulations.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pressing section comprising:

two press rolls arranged to form at least one press nip for dewatering a fibrous material web;

a first and a second dewatering belt arranged to be guided through said at least one press nip with the fibrous material web, wherein the first and second dewatering belts are positioned on opposite sides of the fibrous material web to absorb pressed-out water;

a common guidance path, formed by said first and second dewatering belts guiding the fibrous material web, located after said at least one press nip, relative to a web travel direction;

a separating roll;

a lower one of the first and second dewatering belts being positioned below the fibrous material web and arranged to wrap said separating roll along with the fibrous material web at an end of said common guidance path;

a positionably movable guide roll;

an upper one of the first and second dewatering belts being positioned above the fibrous material web and arranged to be separated from the fibrous material web in a separation path, located at an end of said common guidance path, by guidance around said positionably movable guide roll, which is located downstream of said separation path;

said upper dewatering belt being guided in an unsupported run from an end of said separation path to said positionably movable guide roll, and said positionably movable guide roll being located so that said unsupported run is between 20 and 80 mm; and said lower dewatering belt and the fibrous material web being arranged to wrap said separating roll subsequent to said separation path, relative to the web travel direction, at a wrapping angle of at least about 30°, wherein said positionably movable guide roll is movable to adjust a wedge-opening between the material web and said upper belt in order to limit the amount of air introduced into said wedge-opening, thereby improving web guidance and reducing web flutter on said lower dewatering belt.

2. A pressing section comprising:

two press rolls arranged to form at least one press nip for dewatering a fibrous material web;

a first and a second dewatering belt arranged to be guided through said at least one press nip with the fibrous material web, wherein the first and second dewatering belts are positioned on opposite sides of the fibrous material web to absorb pressed-out water;

a common guidance path, formed by said first and second dewatering belts guiding the fibrous material web, located after said at least one press nip, relative to a web travel direction;

a separating roll;

a lower one of the first and second dewatering belts being positioned below the fibrous material web and arranged to wrap said separating roll along with the fibrous material web at an end of said common guidance path;

an upper one of the first and second dewatering belts being positioned above the fibrous material web and arranged to be separated from the fibrous material web in a separation path, located at an end of said common guidance path, by guidance around a positionably movable guide roll, which is located downstream of said separation path;

said upper dewatering belt being guided in an unsupported run from an end of said separation path to said positionably movable guide roll, and said positionably movable guide roll being located so that said unsupported run is between 20 and 80 mm; and said lower dewatering belt and the fibrous material web being arranged to wrap said separating roll subsequent to said separation path, relative to the web travel direction, at a wrapping angle of at least about 30°; and a removal belt arranged to accept the fibrous material web from said lower dewatering belt, said removal belt being located so that a distance from a lift off point of said lower dewatering felt from said separating roll to a contact point of the web to said removal belt is between 20 and 200 mm, thereby eliminating the need for web stabilizers, additional blowing or suction devices along this distance, wherein said positionably movable guide roll is movable to adjust a wedge-opening between the material web and said upper belt in order to limit the amount of air introduced into said wedge-opening, thereby improving web guidance and reducing web flutter on said lower dewatering belt, and wherein said removal belt is driven at a speed greater than said lower belt.

3. The pressing section in accordance with claim 2, wherein said removal belt comprises a pressing felt of a subsequent pressing nip.

4. The pressing section in accordance with claim 2, wherein said removal belt comprises a transfer belt.

5. The pressing section in accordance with claim 2, wherein said removal belt comprises a drying wire of a subsequent drying group for drying the fibrous material web.

6. The pressing section in accordance with claim 1, wherein said separating roll comprises a suction roll.

7. The pressing section in accordance with claim 6, wherein the fibrous material web comprises a paper, cardboard, or tissue web.

8. The pressing section in accordance with claim 1, wherein said wrapping angle is at least about 45°.

9. A pressing section comprising:

two press rolls arranged to form at least one press nip for dewatering a fibrous material web;

a first and a second dewatering belt arranged to be guided through said at least one press nip with the fibrous material web, wherein the first and second dewatering belts are positioned on opposite sides of the fibrous material web to absorb pressed-out water;

a common guidance path, formed by said first and second dewatering belts guiding the fibrous material web, located after said at least one press nip, relative to a web travel direction;

a separating roll;

a lower one of the first and second dewatering belts being positioned below the fibrous material web and arranged to wrap said separating roll along with the fibrous material web at an end of said common guidance path;

a positionably movable guide roll;

an upper one of the first and second dewatering belts being positioned above the fibrous material web and arranged to be separated from the fibrous material web in a separation path, located at an end of said common guidance path, by guidance around said positionably movable guide roll, which is located downstream of said separation path;

said upper dewatering belt being guided in an unsupported run from an end of said separation path to said positionably movable guide roll, and said positionably movable guide roll being located so that said unsupported run is between 20 and 80 mm; and said lower dewatering belt and the fibrous material web being arranged to wrap said separating roll subsequent to said separation path, relative to the web travel direction, at a wrapping angle of at least about 60°, wherein said positionably movable guide roll is movable to adjust a wedge-opening between the material web and said upper belt in order to limit the amount of air introduced into said wedge-opening, thereby improving web guidance and reducing web flutter on said lower dewatering belt.

10. The pressing section in accordance with claim 1, wherein a time that the fibrous material web remains in said separation path is greater than about 1 ms.

11. The pressing section in accordance with claim 10, wherein the time that the fibrous material web remains in said separation path is greater than about 15 ms.

12. A pressing section comprising:

two press rolls arranged to form at least one press nip for dewatering a fibrous material web;

a first and a second dewatering belt arranged to be guided through said at least one press nip with the fibrous material web, wherein the first and second dewatering belts are positioned on opposite sides of the fibrous material web to absorb pressed-out water;

a common guidance path, formed by said first and second dewatering belts guiding the fibrous material web, located after said at least one press nip, relative to a web travel direction;

a separating roll;

a lower one of the first and second dewatering belts being positioned below the fibrous material web and arranged to wrap said separating roll along with the fibrous material web at an end of said common guidance path;

an upper one of the first and second dewatering belts being positioned above the fibrous material web and arranged to be separated from the fibrous material web in a separation path, located at an end of said common guidance path, by guidance around a positionably movable guide roll, which is located downstream of said separation path;

said upper dewatering belt being guided in an unsupported run from an end of said separation path to said positionably movable guide roll, and said positionably movable guide roll being located so that said unsupported run is between 20 and 80 mm; and said lower dewatering belt and the fibrous material web being arranged to wrap said separating roll subsequent to said separation path, relative to the web travel direction, at a wrapping angle of at least about 30°; and wherein said positionably movable guide roll is movable to adjust a wedge-opening between the material web and said upper belt in order to limit the amount of air introduced into said wedge-opening, thereby improving web guidance and reducing web flutter on said lower dewatering belt said positionably movable guide roll arranged to deflect said upper dewatering belt after an unsupported progression of between 20 and 200 mm following said separation path and being horizontally movable to adjust a wrap angle of the upper dewatering belt over said separating roll to be between 0° and 5° and to adjust a wedge-opening between said upper dewatering belt and the web in order to improve web guidance and reduce web flutter on said lower dewatering belt by limiting the amount of air introduced into said wedge-opening.

13. The pressing section in accordance with claim 12, wherein said unsupported progression is between about 20–80 mm long.

14. The pressing section in accordance with claim 12, further comprising a removal belt arranged to accept the fibrous material web from said lower dewatering belt, wherein a distance between said guide roll and said removal belt is adjustable.

15. The pressing section in accordance with claim 1, further comprising a suctioned removal roll and an air-permeable removal belt wrapped over said suctioned removal roll;

said removal roll being arranged at a distance from said separation roll, such that the fibrous material web and said lower dewatering belt travels from said separating roll to said suctioned removal roll; and said removal belt being arranged to accept the fibrous material web from said lower dewatering belt.

16. A pressing section comprising:

two press rolls arranged to form at least one press nip for dewatering a fibrous material web;

a first and a second dewatering belt arranged to be guided through said at least one press nip with the fibrous material web, wherein the first and second dewatering belts are positioned on opposite sides of the fibrous material web to absorb pressed-out water;

a common guidance path, formed by said first and second dewatering belts guiding the fibrous material web, located after said at least one press nip, relative to a web travel direction;

a separating roll;

a lower one of the first and second dewatering belts being positioned below the fibrous material web and arranged to wrap said separating roll along with the fibrous material web at an end of said common guidance path;

an upper one of the first and second dewatering belts being positioned above the fibrous material web and arranged to be separated from the fibrous material web in a separation path, located at an end of said common guidance path, by guidance around a positionably movable guide roll, which is located downstream of said separation path;

said upper dewatering belt being guided in an unsupported run from an end of said separation path to said positionably movable guide roll, and said positionably movable guide roll being located so that said unsupported run is between 20 and 80 mm; and said lower dewatering belt and the fibrous material web being arranged to wrap said separating roll subsequent to said separation path, relative to the web travel direction, at a wrapping angle of at least about 30°, and a removal roll arranged to accept the fibrous material web from said lower dewatering belt, said removal belt being located so that a distance from a lift off point of said lower dewatering felt from said separating roll to a contact point of the web to said removal roll is between 20 and 200 mm, thereby eliminating the need for web stabilizers, additional blowing or suction devices along this distance, wherein said positionably movable guide roll is movable to adjust a wedge-opening between the material web and said upper belt in order to limit the amount of air introduced into said wedge-opening, thereby improving web guidance and reducing web flutter on said lower dewatering belt.

17. The pressing section in accordance with claim 15, further comprising an adjustable guide roll arranged after an acceptance point for the transfer of the fibrous material web to said removal belt to deflect said lower dewatering belt; and said guide roll being positionably adjustable to position said lower dewatering belt one of at a distance from, in contact with, or to wrap said removal roll.

18. The pressing section in accordance with claim 15, wherein said removal belt is driven at a greater speed than said lower dewatering belt.

19. The pressing section in accordance with claim 1, wherein at least said lower dewatering belts comprises a pressing felt.

20. The pressing section in accordance with claim 19, wherein said upper and lower dewatering belt comprise pressing felts.

21. The pressing section in accordance with claim 1, wherein said at least one press nip comprises an press nip elongated in the web travel direction.

22. The pressing section in accordance with claim 1, further comprising a second press nip, wherein at least a last pressing nip arranged in the web travel direction comprises a press nip elongated in the web travel direction.

23. The pressing section in accordance with claim 22, wherein both press nips are elongated in the web travel direction.

24. A process of guiding a fibrous material web in an apparatus that includes a press nip formed by two press rolls, and a first dewatering belt and a second dewatering belt arranged on opposite sides of the fibrous material web to guide the fibrous material web through the press nip, said process comprising:

guiding the fibrous material web between the first and second dewatering belts over a common guidance path after the press nip to a separating roll;

separating an upper one of the first and second dewatering belts from the fibrous material web and a lower one of the first and second dewatering belts in a separation path in a region of the separating roll;

wrapping the separating roll with the lower dewatering belt and the fibrous material web after the separation path, relative to the web travel direction, at a wrapping angle of at least about 30°;

guiding the upper dewatering belt along an unsupported run from an end of said separation path to a contact point on a movable deflection guide roll, in which the unsupported run is between 20 and 80 mm long;

adjusting a wedge-opening between the material web and the upper belt by moving the movable deflection guide roll in order to reduce the amount of air introduced into the wedge-opening, thereby improving web guidance and reducing web flutter on the lower dewatering belt after the separation path; and removing the web from the lower dewatering belt at a point between 20 and 80 mm following the separation path, wherein web stabilizers, additional blowing or suction devices are not necessary between the end of the separation path and a web removal point.

25. The process in accordance with claim 24, further comprising removing the fibrous material web from the lower dewatering belt with a removal belt.

26. The process in accordance with claim 24, further comprising suctioning the lower dewatering belt and the fibrous material web as they wrap the separating roll.

27. The process in accordance with claim 24, wherein the wrapping angle is at least about 45°.

28. The process in accordance with claim 27, wherein the wrapping angle is about 60°.

29. The process in accordance with claim 24, further comprising maintaining the fibrous material web in the separation path for a time greater than about 1 ms.

30. The process in accordance with claim 29, wherein the time that the fibrous material web remains in the separation path is greater than about 15 ms.

31. The process in accordance with claim 26, further comprising adjustably setting, via the guide roll, a wrapping angle of the upper dewatering belt on the separating roll of between about 0°–5°.

32. The process in accordance with claim 24, further comprising removing the fibrous material web from the lower dewatering belt via an air-permeable removal belt guided over a suctioned removal roll, wherein the removal roll is arranged at a distance from the separation roll, such that the fibrous material web and the lower dewatering belt travels from the separating roll to the suctioned removal roll.

33. The process in accordance with claim 32, further comprising deflecting, via a guide roll, the lower dewatering belt after an acceptance point for the removal of the fibrous material web from the lower dewatering belt so that the lower dewatering belt is adjustably positioned one of at a distance from, in contact with, or to wrap the removal roll.

34. The process in accordance with claim 32, further comprising driving the removal belt at a greater speed than the lower dewatering belt.

* * * * *